US010203149B2

(12) United States Patent
Liu et al.

(10) Patent No.: US 10,203,149 B2
(45) Date of Patent: Feb. 12, 2019

(54) FREEZER AND HINGE FOR SAME

(71) Applicants: HEFEI HUALING CO., LTD., Hefei (CN); HEFEI MIDEA REFRIDGERATOR CO., LTD., Hefei (CN)

(72) Inventors: Chao Liu, Hefei (CN); Xianghai Pu, Hefei (CN); An Wu, Hefei (CN)

(73) Assignees: HEFEI HUALING CO., LTD., Hefei (CN); HEFEI MIDEA REFRIGERATOR CO., LTD., Hefei (CN)

( * ) Notice: Subject to any disclaimer, the term of this patent is extended or adjusted under 35 U.S.C. 154(b) by 0 days.

(21) Appl. No.: 15/305,402

(22) PCT Filed: Jun. 3, 2014

(86) PCT No.: PCT/CN2014/079107

§ 371 (c)(1),
(2) Date: Oct. 20, 2016

(87) PCT Pub. No.: WO2015/161543

PCT Pub. Date: Oct. 29, 2015

(65) Prior Publication Data

US 2017/0045287 A1 Feb. 16, 2017

(30) Foreign Application Priority Data

Apr. 25, 2014 (CN) ..... 2014 1 0174215
Apr. 25, 2014 (CN) ..... 2014 2 0211756

(51) Int. Cl.
*A47B 96/04* (2006.01)
*F25D 23/02* (2006.01)
(Continued)

(52) U.S. Cl.
CPC ..... *F25D 23/028* (2013.01); *E05D 11/082* (2013.01); *E05F 1/1261* (2013.01); *E05Y 2900/306* (2013.01); *F25D 2323/024* (2013.01)

(58) Field of Classification Search
CPC . F25D 23/028; F25D 2323/024; E05D 11/00; E05D 11/82; E05D 11/082; E05Y 2900/306; E05F 1/1261
(Continued)

(56) References Cited

U.S. PATENT DOCUMENTS 2,726,914 A * 12/1955 Allen ..... E05F 1/1261 16/289
2,911,667 A * 11/1959 Burke ..... E05F 1/1261 16/290
(Continued)

FOREIGN PATENT DOCUMENTS

CN 2641244 Y 9/2004
CN 201687314 U 12/2010
(Continued)

OTHER PUBLICATIONS

ISA/CN, International Search Report for PCT/CN2014/079101, dated Jan. 28, 2015.
(Continued)

*Primary Examiner* — Daniel J Troy
*Assistant Examiner* — Timothy M Ayres
(74) *Attorney, Agent, or Firm* — Hodgson Russ LLP

(57) ABSTRACT

The present application relates to a freezer and a hinge for the same. The hinge comprises a base, in which a left side of the base is provided with a first flange portion, a right side of the base is provided with a second flange portion opposite to the first flange portion, and the first flange portion and the second flange portion is provided with sliding grooves opposite to each other; a connecting seat; a first pivot shaft;
(Continued)

a second pivot shaft parallel to the first pivot shaft, in which both ends of the second pivot shaft may slide in the corresponding sliding grooves respectively; a guide rod; a supporting seat; a positioning part; a spring sheath fitted over the guide rod and movable between the positioning part and the supporting seat; and a spring fitted over the spring sheath.

13 Claims, 3 Drawing Sheets

(51) Int. Cl.
*E05D 11/08* (2006.01)
*E05F 1/12* (2006.01)

(58) Field of Classification Search
USPC ..... 312/401, 405
See application file for complete search history.

(56) References Cited

U.S. PATENT DOCUMENTS 3,256,554 A * 6/1966 Turner ..... E05F 1/1261 16/273
3,457,584 A * 7/1969 Phelps ..... E05F 1/1261 16/290
3,496,595 A * 2/1970 Larson ..... E05F 1/1261 16/289
3,683,454 A * 8/1972 Gronbach ..... E05F 1/1261 16/290
3,737,947 A * 6/1973 Little ..... E05F 1/1261 16/290
3,745,608 A 7/1973 Little
3,766,600 A * 10/1973 Little ..... E05F 1/1261 16/290
3,845,433 A * 10/1974 Kraulits ..... H01H 3/3026 200/400
3,876,019 A * 4/1975 Goering ..... B62D 11/183 180/6.48
3,902,220 A * 9/1975 Little ..... E05F 1/1261 16/290
3,927,439 A * 12/1975 Gronbach ..... E05F 1/1261 16/290
4,015,309 A * 4/1977 Gronbach ..... E05F 1/1261 16/290
4,091,502 A * 5/1978 Little ..... E05D 11/1064 16/273
5,454,550 A * 10/1995 Christopherson .... B60G 15/062 188/322.12
5,823,518 A * 10/1998 Nagamitsu ..... F16F 1/122 267/291
6,415,477 B1 * 7/2002 Hosaka ..... E05F 1/1261 16/284
7,216,861 B1 * 5/2007 LaBarbera ..... F16F 9/38 188/322.19
8,572,808 B2 * 11/2013 Bonomie ..... E05F 3/20 16/286
9,686,899 B2 * 6/2017 Kovach ..... A01B 61/046

FOREIGN PATENT DOCUMENTS

| | | | |
|---|---|---|---|
| CN | 202347980 | U | 7/2012 |
| CN | 202970224 | U | 6/2013 |
| CN | 103670093 | A | 3/2014 |
| CN | 203891636 | U | 10/2014 |
| GB | 1121380 | | 7/1968 |
| GB | 1422808 | A | 1/1976 |
| IN | 201303464 | I4 | 8/2013 |
| JP | 2006070996 | | 3/2006 |

OTHER PUBLICATIONS

EPO, Office Action for EP Application No. 14890294.3, dated Dec. 5, 2017.

* cited by examiner

FREEZER AND HINGE FOR SAME

CROSS-REFERENCE TO RELATED APPLICATIONS

The present application is a national phase entry under 35 USC § 371 of International Application PCT/CN2014/079107, filed Jun. 3, 2014, which claims the benefit of and priority to Chinese Patent Application No. 201410174215.5 filed Apr. 25, 2014 and Chinese Patent Application No. 201420211756.6 filed Apr. 25, 2014, the entire disclosures of which are incorporated herein by reference.

FIELD

The present disclosure relates to a technical field of refrigeration devices, and specifically, more particularly to a freezer and a hinge for the same.

BACKGROUND

A hinge of a freezer industry is mostly made of metal materials, and performs transmission of a force by compression of a spring, which achieves an effect of opening and closing of a door body, but the mechanical movement results in certain friction noise between metals, mainly concentrated in positions such as the spring, a guide rod and a rotary shaft, etc. The spring of the hinge in the related art is easily deformed under a pressure when the door is opened, abrasion easily occurs between the guide rod of the hinge and a bearing shell or between the bearing shell and the rotary shaft, and it is found that the spring is easily damaged through a long-term experiment. Furthermore, the amount of extension and contraction of the spring of the hinge is constant and unadjustable; for example, an excessively great or small elastic force will result in inconvenience for use.

SUMMARY

Embodiments of the present disclosure seek to solve at least one of the problems existing in the prior art to at least some extent.

To this end, one objective of the present invention is to provide a hinge for a freezer, in which a spring is difficult to produce a bending deformation, the amount of extension and contraction of the spring is adjustable, and the noise is small.

Another objective of the present invention is to provide a freezer having the above-described hinge.

According to a first aspect of embodiments of the present invention, a hinge for a freezer is provided, and includes a base, in which a left side of the base is provided with a first flange portion, a right side of the base is provided with a second flange portion opposite to the first flange portion, and the first flange portion and the second flange portion are provided with sliding grooves opposite to each other; a connecting seat pivotally connected to an upper part of the base, in which a left side of the connecting seat is provided with a third flange portion adjacent to the first flange portion, and a right side of the connecting seat is provided with a fourth flange portion adjacent to the second flange portion; a first pivot shaft provided to the upper part of the base, in which a left end of the first pivot shaft is pivotally connected to the first flange portion and third flange portion, and a right end of the first pivot shaft is pivotally connected to the second flange portion and the fourth flange portion; a second pivot shaft parallel to the first pivot shaft, in which a left end of the second pivot shaft is connected to the third flange, a right end thereof is connected to the fourth flange, and both ends of the second pivot shaft are slidable in the corresponding sliding grooves of the first flange portion and the second flange portion respectively; a guide rod, in which an upper end of the guide rod is pivotally connected to the second pivot shaft; a supporting seat provided to a lower part of the base, in which an lower end of the guide rod penetrates the supporting seat; a positioning part provided to the guide rod; a spring sheath fitted over the guide rod and movable between the positioning part and the supporting seat; and a spring fitted over the spring sheath and located between the positioning part and the supporting seat.

The hinge according to embodiments of the present invention, by providing the spring sheath between the guide rod and the spring, may effectively prevent the spring from bending towards a direction away from a center line of the guide rod, and avoid direct contact between the spring and the guide rod to prevent friction noise, which improves the performance of the product and improves the user's satisfaction.

In addition, the hinge according to the above-described embodiments of the present invention may further have additional technical features as follows:

According to an embodiment of the present invention, the guide rod is provided with an external thread, and the positioning part is a nut threaded to the guide rod.

According to an embodiment of the present invention, a washer threaded to the guide rod is provided under the nut.

According to an embodiment of the present invention, the spring sheath comprises a round tube portion fitted over the guide rod, and an annular flange portion provided on an upper end of the round tube portion, and an upper end of the annular flange portion abuts against a lower end of the washer.

According to an embodiment of the present invention, the nut is a hexagon nut.

According to an embodiment of the present invention, the guide rod is a cylindrical guide rod.

According to an embodiment of the present invention, a spacer located between a lower end of the spring and the supporting seat is fitted over the lower part of the guide rod.

According to an embodiment of the present invention, the upper end of the guide rod is provided with a C-shaped connecting portion pivotally connected to the second pivot shaft and having an opening on an upper end thereof.

According to an embodiment of the present invention, the second pivot shaft is provided with shaft sleeves located at two sides of the C-shaped connecting portion.

According to a second aspect of the present invention, a freezer is provided, and includes the above-described hinge.

The freezer according to embodiments of the present invention, by providing the spring sheath between the guide rod and the spring, may effectively prevent the spring from bending towards a direction away from a center line of the guide rod, and avoid direct contact between the spring and the guide rod to prevent friction noise, which improves the performance of the product and improves the user's satisfaction.

Additional aspects and advantages of embodiments of present disclosure will be given in part in the following descriptions, become apparent in part from the following descriptions, or be learned from the practice of the embodiments of the present disclosure.

REFERENCE NUMERALS

Figure 1:
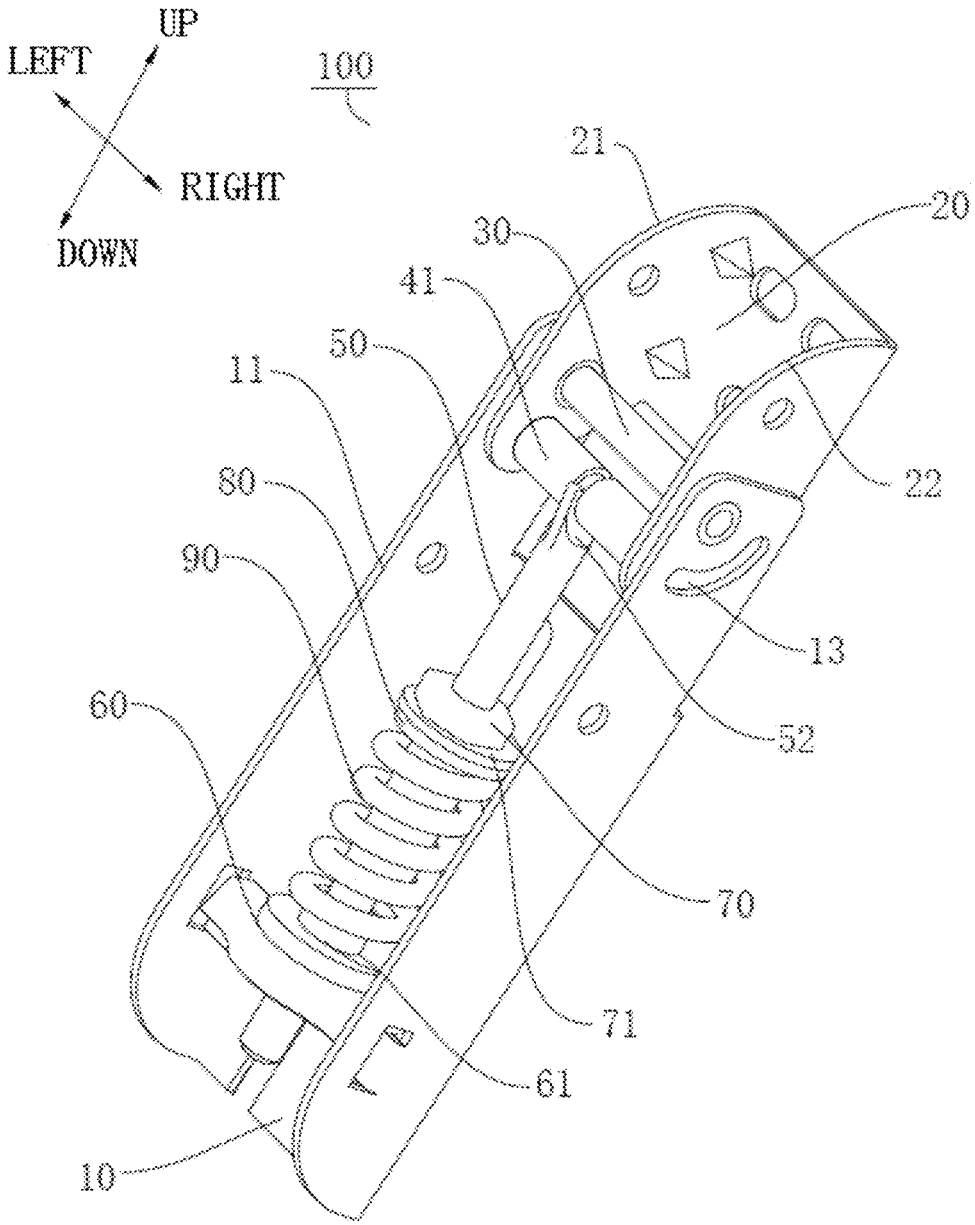
FIG. 1 is a perspective view of a structure of a hinge for a freezer according to an embodiment of the present invention.

100: hinge;

10: base; 11: first flange portion; 12: second flange portion; 13: sliding groove;

20: connecting seat; 21: third flange portion; 22: fourth flange portion;

30: first pivot shaft;

40: second pivot shaft; 41: shaft sleeve; 42: groove body;

50: guide rod; 51: spacer; 52: C-shaped connecting portion;

60: supporting seat; 61: through hole;

70: positioning part; 71: washer;

80: spring sheath; 81: round tube portion; 82: annular flange portion;

90: spring.

DETAILED DESCRIPTION

Description will be made in detail to embodiments of the present disclosure, and examples of the embodiments will be illustrated in drawings. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the specification of the present disclosure, it should be understood that the terms such as "upper", "lower", "front", "rear", "left", "right", "vertical", "horizontal", "top", "bottom", "inner", "outer", etc. should be construed to refer to the orientation as then described or as shown in the drawings under discussion. These relative terms are for convenience and simplifying of description, and do not alone indicate or imply that the device or element referred to must have a particular orientation, or be constructed or operated in a particular orientation. Therefore, these relative terms should not be construed to limit the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications or interactions of two elements, which can be understood by those skilled in the art according to specific situations.

A hinge 100 for a freezer according to embodiments of the present invention will be described below in detail with reference to FIGS. 1 to 3.

Figure 2:
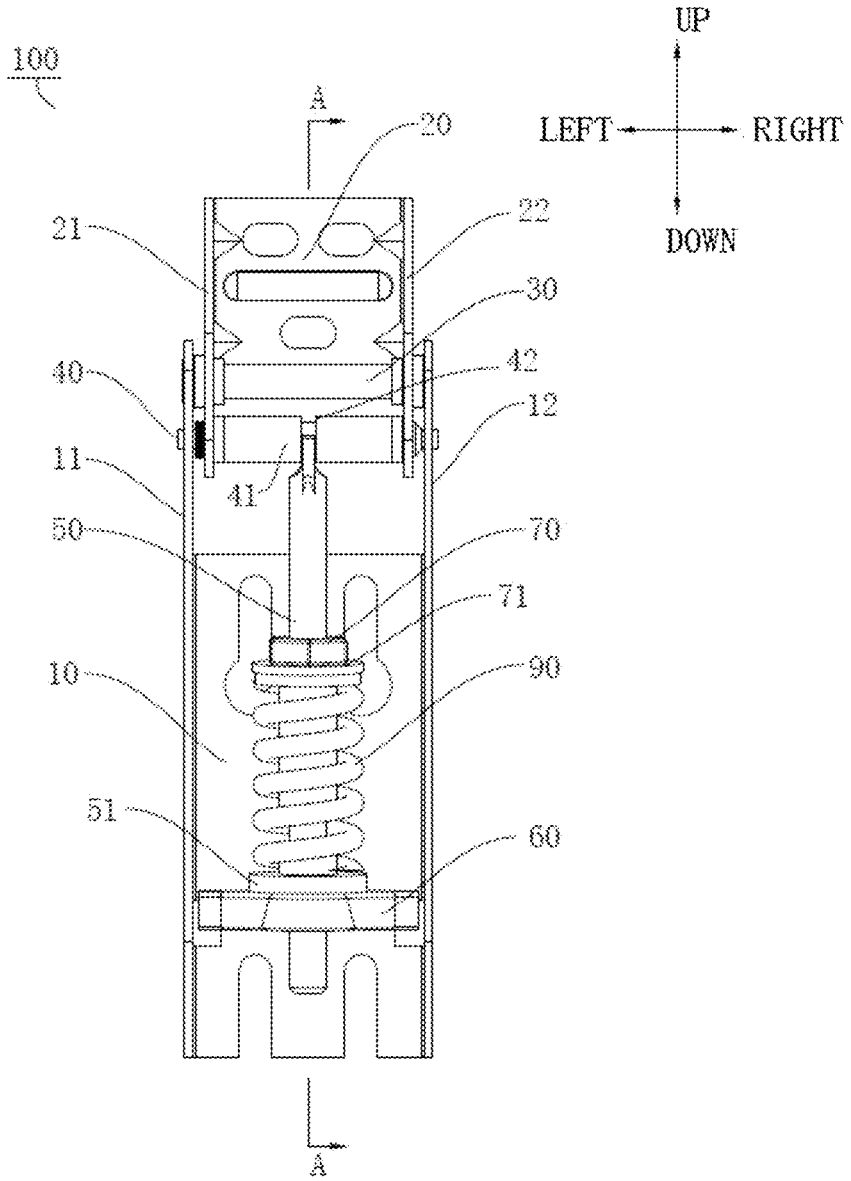
FIG. 2 is a front view of the hinge of FIG. 1.
Figure 3:
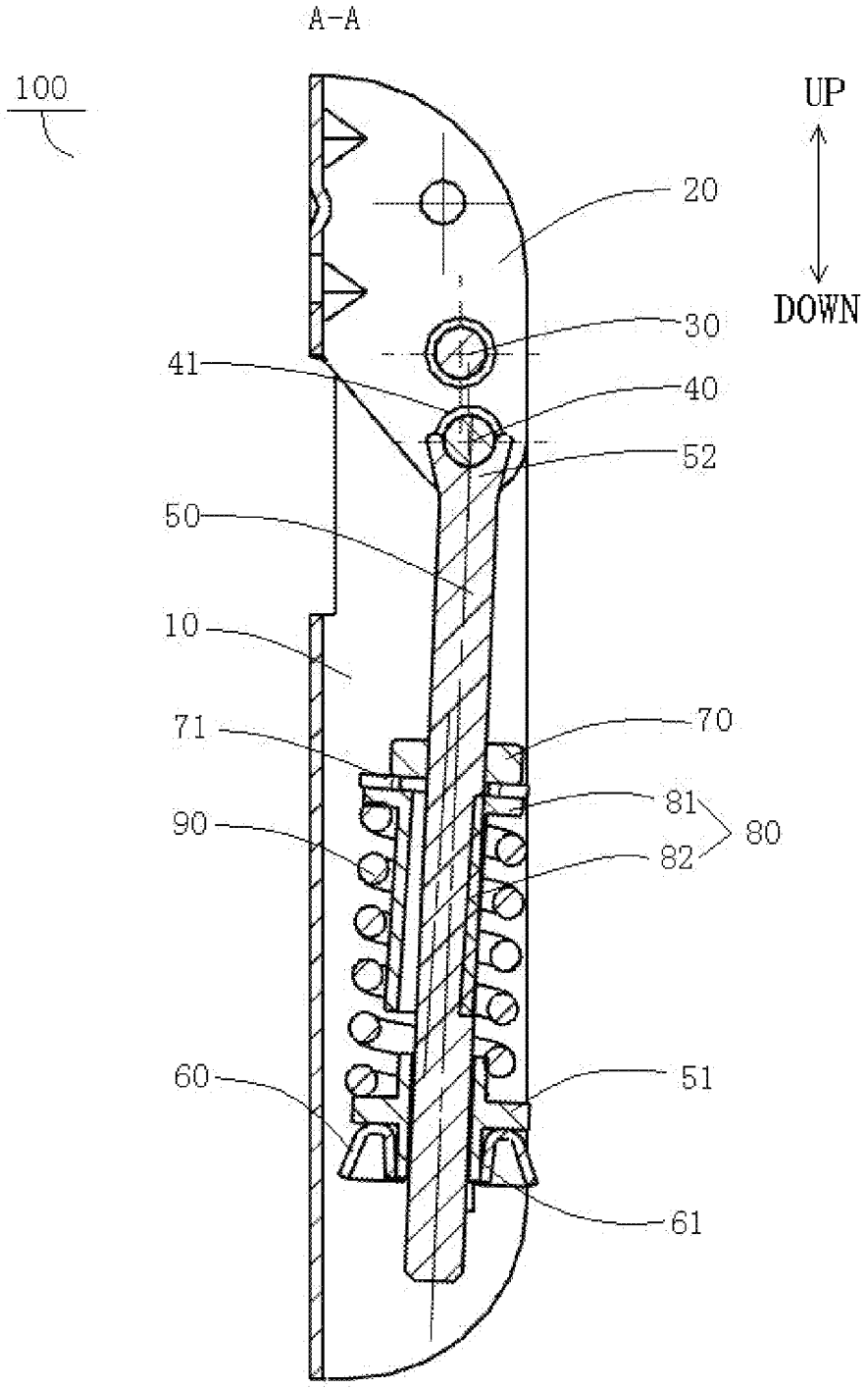
FIG. 3 is a sectional view taken along line A-A of FIG. 2.

As shown in FIGS. 1 to 3, the hinge 100 according to embodiments of the present invention, includes a base 10, a connecting seat 20, a first pivot shaft 30, a second pivot shaft 40, a guide rod 50, a supporting seat 60, a positioning part 70, a spring sheath 80 and a spring 90.

Specifically, a left side of the base 10 is provided with a first flange portion 11, a right side of the base 10 is provided with a second flange portion 12 opposite to the first flange portion 11, the first flange portion 11 and the second flange portion 12 are provided with sliding grooves 13 opposite to each other, and for example, the sliding grooves 13 may be configured as arc shapes. The connecting seat 20 may be pivotally connected to an upper part of the base 10, a left side of the connecting seat 20 is provided with a third flange portion 21 adjacent to the first flange portion 11, and a right side of the connecting seat 20 is provided with a fourth flange portion 22 adjacent to the second flange portion 12. Thus, it is convenient to assemble the first pivot shaft 30 and the second pivot shaft 40 to the base 10 and the connecting seat 20.

The first pivot shaft 30 is provided to the upper part of the base 10, in which a left end of the first pivot shaft 30 is pivotally connected to the first flange portion 11 and the third flange portion 21, and a right end of the first pivot shaft 30 is pivotally connected to the second flange portion 12 and the fourth flange portion 22. The second pivot shaft 40 is parallel to the first pivot shaft 30, in which a left end of the second pivot shaft 40 is connected to the third flange, a right end thereof is connected to the fourth flange, and both ends of the second pivot shaft 40 may slide in the corresponding sliding grooves 13 of the first flange portion 11 and the second flange portion 12 respectively.

The supporting seat 60 is provided to an lower part of the base 10, in which an lower end of the guide rod penetrates the supporting seat; an upper end of the guide rod 50 is pivotally connected to the second pivot shaft 40, and the lower end of the guide rod 50 passes through a through hole 61 of the supporting seat 60. The guide rod 50 is provided with the positioning part 70, and the spring sheath 80 is fitted over the guide rod 50 and is movable between the positioning part 70 and the supporting seat 60.

The spring 90 is fitted over the spring sheath 80, in which an upper end of the spring 90 abuts against a lower end of the positioning part 70, a lower end of the spring 90 abuts against an upper end of the supporting seat 60, and a height of the spring 90 in an axial direction thereof is greater than or equal to that of the spring sheath 80 in an axial direction thereof. It should be understood that, the spring sheath 80 may effectively prevent the spring 90 from bending towards a direction away from a center line of the guide rod 50, and avoid direct contact between the spring 90 and the guide rod 50 to prevent friction noise.

The hinge 100 according to embodiments of the present invention, by providing the spring sheath 80 between the guide rod 50 and the spring 90, may effectively prevent the spring 90 from bending towards the direction away from the center line of the guide rod 50, and avoid direct contact between the spring 90 and the guide rod 50 to prevent friction noise, which improves the performance of the product and improves the user's satisfaction.

Considering that the spring 90 has a certain service life, the spring 90 is prone to a fatigue failure after used for a period of time, which will weaken the elasticity of the spring 90. In order to overcome the problem of reduction in the elasticity of the spring 90 due to the fatigue, in some specific examples of the present invention, the guide rod 50 may be a cylindrical guide rod, the cylindrical guide rod is provided with an external thread (not illustrated), and the positioning part 70 may be a nut threaded to the guide rod 50, such as a hexagon nut. Thus, the elastic force of the spring 90 may be adjusted by adjusting the position of the positioning part 70 on the guide rod 50. The nut may adjust the compression amount of the spring 90 by threaded connection with the guide rod 50, and further make the hinge 100 meet the need of the product for the elastic force of the spring 90 under different conditions, by controlling the magnitude of the elastic force of the spring 90.

As shown in FIG. 2, the nut tends to move in an axial direction of the guide rod 50 under an effect of the elastic force of the spring 90. In order to prevent the nut from moving in the axial direction of the guide rod 50 under the effect of the elastic force of the spring 90, a washer 71 threaded to the guide rod 50 is provided under the nut according to an embodiment of the present invention. It should be understood that, the washer 71 may also be threaded to the guide rod 50, so as to fix the washer 71 on the guide rod 50, prevent the nut and the guide rod 50 from moving due to the elastic force of the spring 90, and meanwhile prevent a use effect of the hinge 100 from being affected due to irregular changes of the elastic force. Specifically, the washer 71 may be an anti-slip washer.

As shown in FIG. 3, according to an embodiment of the present invention, the spring sheath 80 includes a round tube portion 81 and an annular flange portion 82. Specifically, the round tube portion 81 is fitted over the guide rod 50, the annular flange portion 82 is provided on an upper end of the round tube portion 81, and the upper end of the annular flange portion 82 abuts against a lower end of the washer 71. In other words, the annular flange portion 82 extends around a circumferential direction of the round tube portion 81 and protrudes from an outer circumferential wall of the round tube portion 81, the annular flange portion 82 is located between the lower end of the washer 71 and the upper end of the spring 90, the round tube portion 81 is fitted over the guide rod 50, and the spring 90 is fitted over the round tube portion 81.

In addition, it should be understood that, the spring sheath 80 may be a POM spring sheath 80, and the spring sheath 80 of POM material has higher wear resistance, which thus may prevent the spring 90 from bending towards a direction away from an axis of the guide rod to the greatest extent, and avoid friction between the spring 90 and the guide rod 50 to prevent noise.

As shown in FIG. 3, according to an embodiment of the present invention, a spacer 51 located between the lower end of the spring 90 and the supporting seat 60 is fitted over an lower part of the guide rod 50. Alternatively, the spacer 51 may be a rubber spacer 51, which thus may further avoid direct contact between the spring 90 and the supporting seat 60 to prevent noise.

In some specific embodiments of the present invention, as shown in FIGS. 2 and 3, a C-shaped connecting portion 52 with an opening is provided on the upper end of the guide rod 50, and the second pivot shaft 40 is provided in the C-shaped connecting portion 52, which makes it convenient to assemble the guide rod 50 to the second pivot shaft 40. In order to prevent the upper end of the guide rod 50 from moving in an axial direction of the second pivot shaft 40, the second pivot shaft 40 is provided with shaft sleeves 41 located at two sides of the C-shaped connecting portion 52 to define the position of the C-shaped connecting portion 52 on the second pivot shaft 40.

It should be understood that, the shaft sleeves 41 located at two sides of the C-shaped connecting portion 52 may be integrally formed in one piece, and a middle portion of the shaft sleeve 41 at a position where it is connected to the C-shaped connecting portion 52 is provided with a groove body 42 which extends along a circumferential direction of the shaft sleeve 41, is recessed towards an axial direction of the shaft sleeve 41, and is fitted with the C-shaped connecting portion 52. Thus, the C-shaped connecting portion 52 may rotate with respect to the shaft sleeve 41.

It should be noted that, the fact the shaft sleeve 41 fitted with the C-shaped connecting portion 52 of the guide rod 50 is fitted over the second pivot shaft 40 makes the contact between the guide rod 50 and the second pivot shaft 40 change from a point contact into a surface contact, which thus improves the reliability of the hinge 100. The structure of the groove body 42 in the middle of the shaft sleeve 41 may effectively control the relative movement between the guide rod 50 and the second pivot shaft 40, so as to further reduce the noise.

A freezer according to embodiments of the present invention (not illustrated), includes the above-described hinge 100.

The freezer according to embodiments of the present invention, by providing the spring sheath 80 between the guide rod 50 and the spring 90, may effectively prevent the spring 90 from bending towards the direction away from the center line of the guide rod 50, and avoid the direct contact between the spring 90 and the guide rod 50 to prevent friction noise, which improves the performance of the freezer and improves the user's satisfaction.

Reference throughout this specification to "an embodiment," "some embodiments," "an example," "a specific example," or "some examples," device that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. In addition, those skilled in the art can combine the different embodiments or examples and the features of the different embodiments or examples described in this specification without conflicting situations.

Although explanatory embodiments have been shown and described, it would be appreciated that the above embodiments cannot be construed to limit the present disclosure, and changes, alternatives, and modifications can be made in the embodiments within the scope of the present disclosure by those skilled in the art.

What is claimed is:

1. A hinge for a freezer, comprising:

a base, provided with a first flange portion at a left side of the base, and provided with a second flange portion opposite to the first flange portion at a right side thereof, the first flange portion and the second flange portion being provided with sliding grooves opposite to each other;

a connecting seat, pivotally connected to an upper part of the base, provided with a third flange portion adjacent to the first flange portion at a left side of the connecting seat, and provided with a fourth flange portion adjacent to the second flange portion at a right side thereof;

a first pivot shaft, provided to the upper part of the base, and having a left end pivotally connected to the first flange portion and third flange portion, and a right end pivotally connected to the second flange portion and the fourth flange portion;

a second pivot shaft parallel to the first pivot shaft, having a left end connected to the third flange, and a right end connected to the fourth flange, wherein both ends of the second pivot shaft are slidable in the corresponding sliding grooves of the first flange portion and the second flange portion respectively;

a guide rod, having an upper end pivotally connected to the second pivot shaft;

a supporting seat, provided to a lower part of the base, wherein an lower end of the guide rod penetrates the supporting seat;

a positioning part provided to the guide rod;

a spring sheath, fitted over the guide rod and movable between the positioning part and the supporting seat; and a spring, fitted over the spring sheath and located between the positioning part and the supporting seat;

wherein the spring sheath extends along the guide rod such that the spring is prevented from bending away from the guide rod, and the spring sheath is a polyoxymethylene (POM) spring sheath;

wherein a spacer located between a lower end of the spring and the supporting seat is fitted over the lower part of the guide rod, and the spacer is a rubber spacer;

wherein the upper end of the guide rod is provided with a C-shaped connecting portion pivotally connected to the second pivot shaft and having an opening on an upper end thereof, and the second pivot shaft is provided with shaft sleeves located at two sides of the C-shaped connecting portion;

wherein the shaft sleeves are integrally formed in one piece with a middle portion at a position where the shaft sleeves are connected to the C-shaped connecting portion, and the middle portion includes a groove body which extends along a circumferential direction of the shaft sleeves, which is recessed towards an axial direction of the shaft sleeve, and is fitted with the C-shaped connecting portion.

2. The hinge according to claim 1, wherein the guide rod is provided with an external thread, and the positioning part is a nut threaded to the guide rod.

3. The hinge according to claim 2, wherein a washer threaded to the guide rod is provided under the nut.

4. The hinge according to claim 3, wherein the spring sheath comprises a round tube portion fitted over the guide rod, and an annular flange portion provided on an upper end of the round tube portion, and an upper end of the annular flange portion abuts against a lower end of the washer.

5. The hinge according to claim 2, wherein the nut is a hexagon nut.

6. The hinge according to claim 1, wherein the guide rod is a cylindrical guide rod.

7. A freezer, comprising:

a hinge comprising a base, provided with a first flange portion at a left side of the base, and provided with a second flange portion opposite to the first flange portion at a right side thereof, the first flange portion and the second flange portion being provided with sliding grooves opposite to each other;

a connecting seat, pivotally connected to an upper part of the base, provided with a third flange portion adjacent to the first flange portion at a left side of the connecting seat, and provided with a fourth flange portion adjacent to the second flange portion at a right side thereof;

a first pivot shaft, provided to the upper part of the base, and having a left end pivotally connected to the first flange portion and third flange portion, and a right end pivotally connected to the second flange portion and the fourth flange portion;

a second pivot shaft parallel to the first pivot shaft, having a left end connected to the third flange, and a right end connected to the fourth flange, wherein both ends of the second pivot shaft are slidable in the corresponding sliding grooves of the first flange portion and the second flange portion respectively;

a guide rod, having an upper end pivotally connected to the second pivot shaft;

a supporting seat, provided to a lower part of the base, wherein an lower end of the guide rod penetrates the supporting seat;

a positioning part provided to the guide rod;

a spring sheath, fitted over the guide rod and movable between the positioning part and the supporting seat; and a spring, fitted over the spring sheath and located between the positioning part and the supporting seat;

wherein the spring sheath extends along the guide rod such that the spring is prevented from bending away from the guide rod, and the spring sheath is a polyoxymethylene (POM) spring sheath;

wherein a spacer located between a lower end of the spring and the supporting seat is fitted over the lower part of the guide rod, and the spacer is a rubber spacer;

wherein the upper end of the guide rod is provided with a C-shaped connecting portion pivotally connected to the second pivot shaft and having an opening on an upper end thereof, and the second pivot shaft is provided with shaft sleeves located at two sides of the C-shaped connecting portion;

wherein the shaft sleeves are integrally formed in one piece with a middle portion at a position where the shaft sleeves are connected to the C-shaped connecting portion, and the middle portion includes a groove body which extends along a circumferential direction of the shaft sleeves, which is recessed towards an axial direction of the shaft sleeve, and is fitted with the C-shaped connecting portion.

8. The freezer according to claim 7, wherein the guide rod is provided with an external thread, and the positioning part is a nut threaded to the guide rod.

9. The freezer according to claim 8, wherein a washer threaded to the guide rod is provided under the nut.

10. The freezer according to claim 9, wherein the spring sheath comprises a round tube portion fitted over the guide rod, and an annular flange portion provided on an upper end of the round tube portion, and an upper end of the annular flange portion abuts against a lower end of the washer.

11. The freezer according to claim 8, wherein the nut is a hexagon nut.

12. The freezer according to claim 7, wherein the guide rod is a cylindrical guide rod.

13. A hinge for a freezer, comprising:

a base, provided with a first flange portion at a left side of the base, and provided with a second flange portion opposite to the first flange portion at a right side thereof, the first flange portion and the second flange portion being provided with sliding grooves opposite to each other;

a connecting seat, pivotally connected to an upper part of the base, provided with a third flange portion adjacent to the first flange portion at a left side of the connecting seat, and provided with a fourth flange portion adjacent to the second flange portion at a right side thereof;

a first pivot shaft, provided to the upper part of the base, and having a left end pivotally connected to the first flange portion and third flange portion, and a right end pivotally connected to the second flange portion and the fourth flange portion;

a second pivot shaft parallel to the first pivot shaft, having a left end connected to the third flange, and a right end connected to the fourth flange, wherein both ends of the second pivot shaft are slidable in the corresponding sliding grooves of the first flange portion and the second flange portion respectively;

a guide rod, having an upper end pivotally connected to the second pivot shaft;

a supporting seat, provided to a lower part of the base, wherein an lower end of the guide rod penetrates the supporting seat;

a positioning part provided to the guide rod;

a spring sheath, fitted over the guide rod and movable between the positioning part and the supporting seat; and a spring, fitted over the spring sheath and located between the positioning part and the supporting seat;

wherein the spring sheath extends along the guide rod such that the spring is prevented from bending away from the guide rod, and the spring sheath is a polyoxymethylene (POM) spring sheath;

wherein the guide rod is provided with an external thread, and the positioning part is a nut threaded to the guide rod;

wherein a washer threaded to the guide rod is provided under the nut;

wherein the spring sheath comprises a round tube portion fitted over the guide rod, and an annular flange portion provided on an upper end of the round tube portion, and an upper end of the annular flange portion abuts against a lower end of the washer;

wherein a spacer located between a lower end of the spring and the supporting seat is fitted over the lower part of the guide rod, and the spacer is a rubber spacer, wherein the upper end of the guide rod is provided with a C-shaped connecting portion pivotally connected to the second pivot shaft and having an opening on an upper end thereof, and the second pivot shaft is provided with shaft sleeves located at two sides of the C-shaped connecting portion, wherein the shaft sleeves are integrally formed in one piece with a middle portion at a position where the shaft sleeves are connected to the C-shaped connecting portion, and the middle portion includes a groove body which extends along a circumferential direction of the shaft sleeves, which is recessed towards an axial direction of the shaft sleeve, and is fitted with the C-shaped connecting portion.

* * * * *